United States Patent [19]

Provost

[11] Patent Number: 4,472,241

[45] Date of Patent: Sep. 18, 1984

[54] CO-REFINING OF ARAMID FIBRIDS AND FLOC

[75] Inventor: Richard L. Provost, Midlothian, Va.

[73] Assignee: E. I. Du Pont De Nemours and Company, Wilmington, Del.

[21] Appl. No.: 504,502

[22] Filed: Jun. 15, 1983

[51] Int. Cl.[3] ..... D21B 1/04

[52] U.S. Cl. ..... 162/28; 162/9; 162/146; 162/157.3; 241/21; 264/140

[58] Field of Search ..... 162/1, 146, 9, 13, 157.3, 162/157.4, 157.5; 264/140; 241/21, 244, 296

[56] References Cited

U.S. PATENT DOCUMENTS

| | | | |
|---|---|---|---|
| 2,999,788 | 9/1961 | Morgan | 162/146 |
| 3,240,437 | 3/1966 | Horstman | 241/296 |
| 3,745,645 | 7/1973 | Kurth et al. | 241/296 |
| 3,756,908 | 9/1973 | Gross | 162/146 |
| 4,039,154 | 8/1977 | Peterson | 241/296 |
| 4,237,081 | 12/1980 | Murphy et al. | 264/140 |

*Primary Examiner*—Peter Chin

[57] ABSTRACT

An aqueous slurry of 0.2 to 2.0 weight percent aramid fibrids and aramid floc in a weight ratio of 0.25 to 20, respectively, is refined in a disc refiner having grooved facing plates with surface dams, the distance between the facing plates being 0.20 to 1.0 mm.

7 Claims, 3 Drawing Figures

CO-REFINING OF ARAMID FIBRIDS AND FLOC

DESCRIPTION

Technical Field

This invention relates to an improved process for the preparation of an aqueous suspension of aramid fibrids and aramid floc suitable for the preparation of paper or pressboard having excellent electrical properties.

Aramid papers prepared from an aqueous dispersion of aramid fibrids and aramid floc are known, e.g., from U.S. Pat. No. 3,756,908. The fibrids are prepared according to the shear precipitation process described in U.S. Pat. No. 2,999,788. In order to provide good electrical properties in the papers it is necessary to refine the fibrids before use in paper preparation. The refining reduces the size of the fibrids and unrolls the film fibrils making up the fibrids. To avoid damage to the floc, the refining is normally carried out separately, i.e., before combination with the floc. An aqueous dispersion of refined fibrids is normally combined with an aqueous dispersion of floc at the head box of a paper machine, e.g., by using a T mixer.

Some paper making machines are not conducive to separate refining of the fibrids and further, it would be more economical to process a single aqueous slurry comprised of aramid fibrids and aramid floc. Efforts to refine an aqueous slurry of aramid fibrids and aramid floc using the usual refiners for cellulosic pulps have been unsuccessful. Adjustment of such refiners so that the aramid fibrids are suitably refined results in excessive damage to the floc.

It has now been found that a slurry of aramid fibrids and aramid floc can be suitably refined without damage to the floc by using a disc refiner having particular refiner plates at a relatively open spacing.

BRIEF DESCRIPTION OF THE INVENTION

This invention provides an improved process for refining an aqueous slurry of aramid fibrids and aramid floc wherein an aqueous slurry comprised of 0.2 to 2.0 percent by weight aramid fibrids and 2 to 12 mm long aramid floc in a weight ratio of 0.25 to 20, respectively, is processed in a disc refiner fitted with facing circular plates rotable with respect to one another having multiple radially extending surface grooves, the grooves being at an angle of 0° to 45° to the plate radius and being 1.6 to 6.4 mm deep, 1.6 to 6.4 mm wide and 1.6 to 6.4 mm apart, each groove having at least one dam extending at least halfway to the plate surface, the clearance between the surfaces of the facing plates being 0.20 to 1.0 mm. Preferably the floc is 2 to 6 mm long. Preferably the ratio of fibrids to floc is 0.6 to 1.5 and most preferably 1.0. Preferably the clearance between the facing plates is 0.4 to 0.5 mm. Preferably a double disc refiner is used.

DETAILED DESCRIPTION OF THE INVENTION

Figure 1:
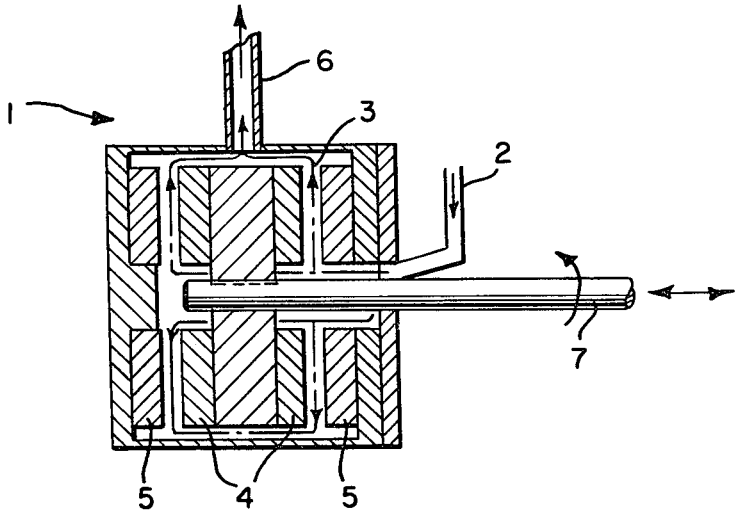
FIG. 1 is a schematic cross-section of a double disc refiner suitable for use in the process of the present invention.

Fibrids are small, non-granular, non-rigid fibrous or film-like particles. Two of their three dimensions are on the order of microns. Their smallness and suppleness allows them to be deposited in physically entwined configurations such as are commonly found in papers made from wood pulp. Fibrids may be prepared by shear precipitation of polymer solutions into coagulating liquids as is well known from U.S. Pat. No. 2,999,788.

Fibrids of wholly aromatic polyamides (aramids) are also known from the above U.S. Pat. and also from U.S. Pat. No. 3,756,908. A process for preparing poly(m-phenylene isophthalamide) (MPD-I) fibrids is disclosed in U.S. Pat. No. 3,756,908 column 5 lines 37–54. Before use in paper or pressboard manufacture, the fibrids are refined to provide improved electrical properties in the products made therefrom and also to provide better sheet quality on paper forming machines. Fibrids are ordinarily refined separately from any floc (short fibers) which may also be used in paper or pressboard manufacture.

Floc may be defined as short length fibers of up to 1.25 cm in length. Floc is obtained by processing yarn or tow through a suitable cutter. The preparation of amorphous and crystalline MPD-I floc is described in U.S. Pat. No. 3,756,908 column 5 line 68 to column 6 line 25. In the process of the present invention the floc should be 2 to 12 mm long. If the refined slurry of aramid fibrids and aramid floc is to be used in paper manufacture on a Fourdrinier machine, the floc is preferably about 6 mm long. When used on a cylinder machine for the manufacture of pressboard, the floc is preferably about 3 mm long.

The process of the present invention may be carried out using a disc refiner which may be of the single disc or double disc type. In disc refiners, the slurry being refined is pumped between closely spaced rotor and stator discs which usually have a surface of more or less radially extending surface grooves. Most commonly, aqueous slurries of cellulosic material such as wood pump are refined in such equipment using very closely spaced rotor and stator discs of this type.

When aqueous slurries of aramid fibrids and aramid floc are processed under such conditions, suitable refining of the fibrids does not occur because the fibrids tend to roll into balls and further the floc is severely damaged by cutting and bending of the fibers.

It has now been found that aqueous slurries of aramid fibrids and aramid floc can be suitably refined using disc refiners without damage to the floc if particular refiner plates are used at a relatively open setting of 0.2 to 1.0 mm between the plates. Useful refiner plates have multiple radially extruding grooves, the grooves being at an angle of 0° to 45° to the plate radius and being 1.6 to 6.4 mm wide, 1.6 to 6.4 mm deep and 1.6 to 6.4 mm apart, each groove having at least one dam extending at least half the distance to the plate surface. Preferably the dams extend to the plate surface. Most preferably the spacing between the plates is 0.4 to 0.5 mm. If necessary for suitable refining the aqueous slurry of aramid fibrids and aramid floc may be passed through the disc refiner more than once.

It is preferred that a double disc refiner such as a Beloit-Jones DD 3000 refiner be used, preferably by pumping the slurry along the axis of the refiner through suitable openings so that the slurry passes outwardly between the two sets of discs for removal. The rotors of the refiner are operated at 400 to 1200 revolutions/min, preferably at about 900 revolutions/min.

The refined slurry produced by the process of the present invention is useful in the preparation of paper on a Fourdrinier machine and is particularly useful in the preparation of pressboard using a cylinder paper forming machines.

DETAILED DESCRIPTION OF THE DRAWINGS

FIG. 1 is a schematic cross-section of a double disc refiner suitable for use in the process of the present invention. An aqueous slurry of aramid fibrids and aramid floc is pumped through inlet 2 along the axis of refiner 1 outwardly between rotor plates 4 and stator plates 5 to outlet 6. Openings along the axis of the rotor plates permits slurry to be processed between both sets of discs. The distance between the rotor and stator plates may be adjusted with gap adjustment 7.

Figure 2:
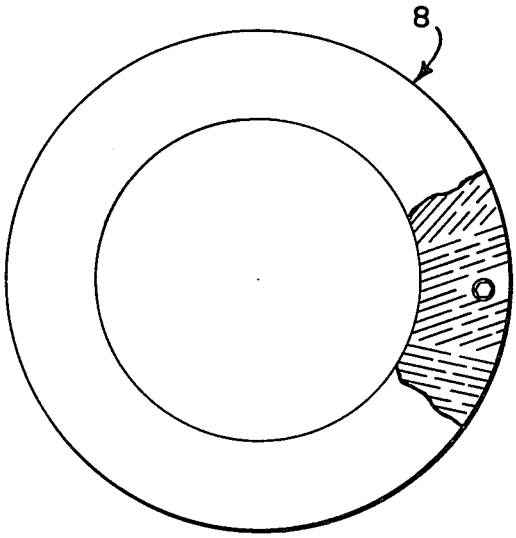
FIG. 2 is a partial surface view of a grooved refiner plate suitable for use in the process of the present invention.

FIG. 2 is a surface view of a disc refiner plate suitable for use in the process of the present invention.

Figure 3:
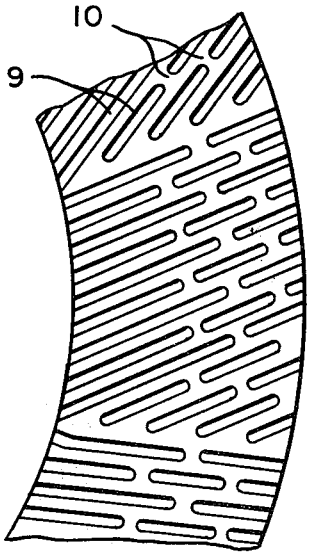
FIG. 3 is an enlarged surface view of a section of the refiner plate of FIG. 2.

FIG. 3 is an enlarged surface view of a section of the refiner plate of FIG. 2. Refiner plate 8 has grooves 9 interrupted by dams 10.

TESTS

Example

Filaments of poly(m-phenylene isophthalamide)(MPD-I) having an inherent viscosity of 1.5 were dry spun from a solution containing 19% MPD-I, 70% dimethylacetamide (DMAc), 9% calcium chloride, and 2% water. On leaving the drying tower the as-spun filaments were given a preliminary wash with water so that they contained about 60% DMAc, 15% calcium chloride, and 100–150% water, based on the weight of dry polymer. The filaments were washed and drawn 4× at 90° C. in a countercurrent extraction-draw process in which the calcium chloride determined as chloride content and DMAc content were reduced to about 0.1% and 0.5%, respectively. The filaments were crystallized immediately after drawing by passing them over hot rolls at a temperature of about 340° C. The filaments so produced had a linear density of 2.2 dtex (2.0 dpf), a tenacity of about 3.7 dN/tex (4.2 gpd), an initial modulus of 70 dN/tex (79 gpd) and an elongation of 34%. The filaments were cut to floc having a length of 0.32 cm (0.135 in).

Fibrids of poly(m-phenylene isophthalamide) (MPD-I) having an inherent viscosity of 1.5 were prepared substantially as described by Gross in U.S. Pat. No. 3,756,908, issued Sept. 4, 1973, column 5 lines 34–54, stopping short of the refining step.

An aqueous slurry was prepared containing 1.0 wt.% fibrids and floc having a composition of 60% of the above MPD-I fibrids and 40% of the above MPD-I floc. The slurry was held in an agitated vessel and then pumped to a double disc refiner (Beloit Jones Model 3000 20-inch Double Disc refiner, made by the Jones Division of the Beloit Corporation, Dalton, Mass. 01226), as shown in FIG. 1, equipped with refining discs containing narrow bars and channels with surface dams, as shown in FIGS. 2 and 3. The plates of the refiner were positioned with a gap of 0.5 mm (20 mils) between the rotor and the stator plates. The rotor plates were operated at 900 rpm. After the slurry had been passed once through the refiner, it was again pumped through the refiner in a second pass under the same operating conditions. The slurry was then found to be ready for processing through a paper machine, with the fibrids well reduced in size and well opened into fibrid films, while the floc fibers were in good condition and well distributed among the fibrids. The slurry made in this way was then processed on a cylinder paper machine where sheets were wet laid and the wet sheets subsequently layered and pressed to form pressboards. The pressboards were found to be equivalent in tensile properties to boards made by a separate refining process (fibrids refined alone, then combined with floc after refining).

The process was repeated, changing the gap between the rotor and the stator plates from 0.5 mm to 1 mm (40 mils). Slurry of good quality was obtained. However, when the gap was made wider than 1 mm, the fibrids were not adequately refined and the quality of the slurry was not adequate to make acceptable pressboard.

The process was repeated again, changing the gap to 0.2 mm (8 mils). Slurry of good quality was obained. However, when the gap was narrowed to less than 0.2 mm, the fibrids became rolled or clumped together, while the floc fibers were damaged with bends and cuts observed in the floc fibers, with the result that the quality of the slurry was not adequate to make acceptable pressboard.

I claim:

1. Process for refining an aqueous slurry of aramid fibrids and aramid floc wherein an aqueous slurry comprised of 0.2 to 2.0 percent by weight of aramid fibrids and 2 to 12 mm long aramid floc in a weight ratio of 0.25 to 20, respectively, is processed in a disc refiner fitted with facing circular plates rotable with respect to one another having multiple radially extruding grooves, the grooves being at an angle of 0° to 45° to the plate radius and being 1.6 to 6.4 mm wide, 1.6 to 6.4 mm deep and 1.6 to 6.4 mm apart, each groove having a least one dam extending at least half the distance to the plate surface, the clearance between the surfaces of the facing plates being 0.20 to 1.0 mm.

2. Process of claim 1 wherein the floc is 2 to 6 mm long.

3. Process of claim 1 wherein the weight ratio of fibrids to floc is 0.6 to 1.5.

4. Process of claim 3 wherein the weight ratio of fibrids to floc is 1.0.

5. Process of claim 1 wherein the clearance is 0.4 to 0.5 mm.

6. Process of claim 1 wherein a double disc refiner is used.

7. Process of claim 6 wherein the slurry is passed through the refiner more than once.

* * * * *